US009506431B2

(12) United States Patent
Korn et al.

(10) Patent No.: US 9,506,431 B2
(45) Date of Patent: Nov. 29, 2016

(54) DETACHABLE CONNECTING DEVICE FOR CONNECTING AT LEAST TWO FUNCTIONAL COMPONENTS AND FUNCTIONAL COMPONENTS

(71) Applicant: MANN+HUMMEL GMBH, Ludwigsburg (DE)

(72) Inventors: Alexander Korn, Gueglingen (DE); Gerrit-Tobias Speidel, Ludwigsburg (DE); Mustafa Guengoer, Backnang (DE); Andreas Friedrich, Neuhaus-Schierschnitz (DE)

(73) Assignee: MANN+HUMMEL GMBH, Ludwigsburg (DE)

( * ) Notice: Subject to any disclaimer, the term of this patent is extended or adjusted under 35 U.S.C. 154(b) by 103 days.

(21) Appl. No.: 14/516,052

(22) Filed: Oct. 16, 2014

(65) Prior Publication Data

US 2015/0102596 A1 Apr. 16, 2015

(30) Foreign Application Priority Data

Oct. 16, 2013 (DE) ..... 10 2013 017 166

(51) Int. Cl.
*F02M 35/10* (2006.01)
*F02M 35/112* (2006.01)

(52) U.S. Cl.
CPC ... *F02M 35/10085* (2013.01); *F02M 35/1034* (2013.01); *F02M 35/10078* (2013.01); *F02M 35/112* (2013.01); *Y10T 29/49398* (2015.01)

(58) Field of Classification Search
CPC ..... F02M 36/10085; F02M 35/10078; F02M 35/10321; F02M 35/1034; F02M 35/112; Y10T 29/49398
USPC ..... 123/184.21
See application file for complete search history.

(56) References Cited

U.S. PATENT DOCUMENTS

| | | | | |
|---|---|---|---|---|
| 5,857,659 | A * | 1/1999 | Kato et al. | 248/634 |
| 6,662,772 | B1 * | 12/2003 | Murphy | 123/184.21 |
| 2006/0272683 | A1 * | 12/2006 | Wallace | 134/138 |
| 2010/0294227 | A1 * | 11/2010 | Magnan et al. | 123/184.55 |
| 2014/0311143 | A1 * | 10/2014 | Speidel et al. | 60/599 |

FOREIGN PATENT DOCUMENTS

| | | | |
|---|---|---|---|
| DE | 19720254 | A1 | 11/1998 |
| DE | 102005056209 | A1 | 6/2007 |
| DE | 102006014477 | A1 | 10/2007 |
| DE | 202007018074 | U1 | 6/2009 |
| DE | 102011056782 | A1 | 10/2012 |

* cited by examiner

*Primary Examiner* — Marguerite McMahon
(74) *Attorney, Agent, or Firm* — James Hasselbeck

(57) ABSTRACT

A detachable connecting device for connecting first and second functional components to each other has a connecting element arranged in a connecting element receptacle of the first functional component so as to be force-transmitting. A bushing that is circumferentially closed is arranged on the connecting element. A bushing receptacle is provided on the second functional component. The bushing together with the connecting element is arranged in the bushing receptacle for realizing force transmission between connecting element and second functional component. The bushing receptacle has a circumferential side relative to the connecting axis that is provided with an insertion section with insertion opening to insert the bushing from outside of the circumferential side into the interior of the bushing receptacle or to remove the bushing from the interior of the bushing receptacle through the circumferential side.

12 Claims, 4 Drawing Sheets

DETACHABLE CONNECTING DEVICE FOR CONNECTING AT LEAST TWO FUNCTIONAL COMPONENTS AND FUNCTIONAL COMPONENTS

CROSS-REFERENCE TO RELATED APPLICATION

This application claims the benefit of U.S. German patent application No. 10 2013 017 166.0 filed Oct. 16, 2013.

BACKGROUND OF THE INVENTION

The invention concerns a detachable connecting device for connecting at least two functional components, in particular an intake pipe housing with a cylinder head, in particular of an internal combustion engine, in particular of a motor vehicle, comprising at least one pin-like connecting element that, by means of a rotary and/or plug-in movement relative to an imaginary connecting axis of the connecting device, can be arranged so as to be force-transmitting in at least one connecting element receptacle of a first one of the functional components.

Also, the invention concerns a functional component, in particular an intake pipe housing, comprising at least one part of at least one detachable connecting device, in particular of a connecting device according to the invention, for connecting the functional component with at least one other functional component, in particular a cylinder head, in particular of an internal combustion engine, in particular of a motor vehicle, wherein the connecting device comprises at least one pin-like connecting element that, by means of a rotary and/or plug-in movement relative to an imaginary connecting axis of the connecting device, can be arranged in at least one connecting element receptacle of the at least one other functional component in a force-transmitting way.

A commercially available intake pipe of an air intake system of an internal combustion engine is detachably connected by means of screws on a cylinder head of the internal combustion engine. At locations that are difficult to access, in particular in an engine compartment of a motor vehicle, it may be difficult to actuate the screws.

The invention has the object to design a connecting device and a functional component of the aforementioned kind such that the connection between the at least two functional components can be realized and actuated in a simple way.

SUMMARY OF THE INVENTION

This object is solved according to the invention in that the connecting device comprises at least one bushing, which is circumferentially closed relative to the connecting axis and can be arranged on the at least one connecting element, and at least one bushing receptacle of a second one of the functional components in which the at least one bushing with the at least one connecting element can be arranged for realizing force transmission between the second functional component and at least the connecting element, wherein the at least one bushing receptacle, at a circumferential side relative to the connecting axis, comprises an insertion section with an insertion opening for inserting the at least one bushing into the interior of the at least one bushing receptacle from outside of the circumferential side and/or for removal of the at least one bushing from the at least one bushing receptacle through the circumferential side, i.e., in radial direction to the connecting axis.

According to the invention, at least one sleeve-shaped bushing is provided which is closed circumferentially. For closing the connecting device, the at least one bushing is arranged on the at least one connecting element. The at least one connecting element can be inserted for this purpose into the at least one bushing. The at least one bushing can be removed together with the connecting element from the at least one bushing receptacle through the circumferential side. In reverse, the at least one bushing for connecting the functional components can be inserted with the at least one connecting element through the circumferential side into the at least one bushing receptacle. In this way, the at least one bushing together with the at least one connecting element can remain on the first functional component. The at least one connecting element can thus be mounted also at locations that are difficult to access. In particular in motor vehicles, the functional components can be mounted so as to be difficult to access in an engine compartment. In this case, it can be advantageous that the at least one connecting element must not be removed completely in order to be able to separate the functional components.

Accordingly, at least one connecting element can remain in a bushing upon disassembly when, for example, this at least one connecting element is not accessible due to mounting space limitations at the time of disassembly of the functional component.

Advantageously, the connecting device can comprise one or several bushing receptacles with an insertion opening with parallel orientation as well as several further bushing receptacles without insertion opening of an insertion section at the circumferential side.

Advantageously, the at least one bushing receptacle, in particular the insertion section, can be matched to the employed at least one bushing. In this way, it is not required that the at least one bushing is matched especially to the at least one connecting element and/or the at least one bushing receptacle. In this way, commercially available bushings can be employed. For all connecting devices the same bushings can be employed which simplifies greatly handling and mounting of the components.

A height of the at least one bushing axial to the connecting axis can be advantageously between approximately 14 mm and approximately 40 mm, preferably between approximately 20 mm and approximately 30 mm.

A height of the at least one bushing receptacle, in particular a receiving section, axial to the connecting axis can be advantageously between approximately 14 mm and approximately 40 mm, preferably between approximately 20 mm and approximately 30 mm.

Advantageously, the at least one bushing can be comprised of metal or comprise metal. In this way, the mechanical stability of the at least one bushing can be improved.

Advantageously, at least one bushing of the connecting device can have a non-round, for example, an oval, shape or can be provided with a slotted hole.

The bushings can be turned, rolled or produced by a pressing method.

An expansion of the insertion section, in particular a width of inner sides of sidewalls of the insertion section, transverse to the connecting axis, can be advantageously between 2 mm and 6 mm, preferably approximately 4 mm. In this way, the at least one bushing upon insertion into the at least one bushing receptacle and upon removal from the bushing receptacle can be guided easily and stably within the insertion section, in particular between the sidewalls of the insertion section.

The at least one connecting element can advantageously be suitable for transmission of tensile forces or pressure forces which are oriented axially to the connecting axis.

Advantageously, the at least one connecting element can be a screw, in particular a machine screw, or can comprise one. The at least one connecting element can thus be screwed by means of a turning movement into a corresponding thread in the first functional component. Instead of a screw, a different kind of rotary/plug-in connecting element, in particular a connecting element of a bayonet-like connection, can be provided also.

The at least one connecting element receptacle of the first functional component can be advantageously provided with a thread. At least one part of the first functional component that is provided with the thread can be comprised of metal or comprise metal. In this way, the mechanical stability of the thread can be increased. Advantageously, the first functional component can be comprised of metal or comprise metal. The thread can be arranged directly in the first functional component. Instead, a thread insert can be employed also.

The at least one bushing can be connected frictionally and/or with form fit with the at least one bushing receptacle. The at least one bushing can advantageously be clamped in the at least one bushing receptacle. By means of the at least one bushing, appropriate forces can be transmitted between the at least one connecting element and the second functional component. The at least one bushing can prevent in this context that the force is directly transmitted from the at least one connecting element onto the second functional component, in particular the bushing receptacle. The risk of damaging the at least one bushing receptacle can thus be reduced. Also, positional tolerance between the functional components can be compensated better.

The insertion opening of the insertion section of the at least one bushing receptacle can be designed such that the at least one bushing can be inserted from outside of the circumferential side into the interior of the at least one bushing receptacle. For separation, the at least one bushing can be accordingly removed through the circumferential side from the at least one bushing receptacle.

An axial expansion of the insertion opening relative to the connecting axis can be advantageously at least as large as the corresponding axial expansion of the at least one bushing. In this way, the at least one bushing can be simply inserted and also removed in its final orientation, which it is to assume in the bushing receptacle, from outside of the circumferential side into the interior of the at least one bushing receptacle.

The at least one bushing can advantageously be inserted transversely to the connecting axis, in particular approximately in radial direction, into the at least one bushing receptacle. The at least one bushing receptacle can form with the at least one bushing a kind of clamping connection or a locking connection. The clamping connection or locking connection can be simply closed and separated.

Advantageously, one end of the at least one connecting element that is facing away from the at least one connecting element receptacle can be accessible from the exterior of the functional component. In this way, the connecting element can be actuated easily, in particular released or fixed.

Advantageously, the detachable connecting device can be provided for attachment of an intake pipe housing on a cylinder head of an internal combustion engine. The cylinder head can be the first functional component or comprise it. The intake pipe housing can be the second functional component or comprise it. The at least one connecting element receptacle can advantageously be arranged on the cylinder head. The at least one bushing receptacle can advantageously be arranged on the intake pipe housing.

The invention is not limited to functional components of an internal combustion engine of a motor vehicle. Instead, it can also be used in other kinds of internal combustion engines, in particular industrial motors. It can also be used independent of internal combustion engines, in particular in motor vehicles.

In an advantageous embodiment, the at least one bushing receptacle can comprise an approximately U-shaped inner profile. The at least one bushing can thus be inserted in a simple way through the opening of the "U". The legs of the "U" can form in this context sidewalls of the insertion section that delimit the insertion opening. The sidewalls can stabilize the insertion section. Moreover, the sidewalls can serve as guide means for the at least one bushing upon installation or disassembly.

In a further advantageous embodiment, an inner width of the insertion opening at least in one clamping area of the at least one bushing receptacle, viewed in circumferential direction relative to the connecting axis, can be smaller than an outer diameter of the at least one bushing at least in a section of the at least one bushing which is located, when the bushing is mounted, axially relative to the connecting axis at the level of the clamping area. In its installed state, the at least one bushing can be secured in the clamping area. At least in the clamping area a type of clamping connection or locking connection can be realized. The at least one clamping area can thus prevent that the at least one bushing can escape undesirably from the at least one bushing receptacle.

In the clamping area, a mechanical, in particular elastic, resistance can be realized which must be overcome for removal of the at least one bushing from the at least one bushing receptacle. The mechanical resistance can advantageously be so small that the at least one bushing can be inserted easily into the at least one bushing receptacle and removed from it with minimal force expenditure. On the other hand, the required force expenditure can be sufficiently large so that the at least one bushing in the at least one bushing receptacle can be stably secured.

The inner width of the insertion opening can be advantageously between approximately 5 mm and approximately 20 mm, preferably between approximately 10 mm and approximately 15 mm, preferably approximately 12.5 mm.

An expansion of the clamping area axial to the connecting axis can advantageously be between approximately 8 mm and approximately 18 mm, preferably approximately 14.2 mm.

Advantageously, an outer diameter of the at least one bushing can be at least as large as an inner diameter of the at least one bushing receptacle, in particular of the receiving section of the at least one bushing receptacle, in particular at the level of the clamping area. In this way, the at least one bushing can be clamped stably in the at least one bushing receptacle.

The outer diameter of the at least one bushing can advantageously be between approximately 5 mm and approximately 20 mm, preferably between approximately 10 mm and approximately 15 mm, preferably approximately 13 mm.

An inner diameter of the at least one bushing receptacle, in particular of the receiving section of the bushing receptacle, in particular at the level of the clamping area can advantageously be between approximately 5 mm and approximately 20 mm, preferably between approximately 10 mm and approximately 15 mm, preferably approximately 12.8 mm.

Advantageously, the inner width of the insertion opening at least in the clamping area of the insertion section, viewed in circumferential direction relative to the connecting axis, can be smaller than the inner diameter of the at least one bushing receptacle, in particular of the receiving section of the bushing receptacle, at least in the section of the bushing receptacle that is located axially relative to the connecting axis at the level of the clamping area of the insertion section. In this way, upon insertion the at least one bushing, after passing the insertion section, can lock in the at least one bushing receptacle, in particular in the receiving section.

In a further advantageous embodiment, the at least one bushing receptacle can comprise at least one undercut at a transition of the insertion section into a receiving section, in particular in a clamping area of the bushing receptacle. With the at least one undercut, a tapered section or constriction of the insertion opening relative to the receiving section can be realized in a simple way.

Advantageously, at least two undercuts can be arranged on sides of the insertion section, in particular of the insertion opening, which are positioned circumferentially opposite to each other relative to the connecting axis. In this way, a uniform constriction and thus a uniform securing action of the at least one bushing in the at least one bushing receptacle can be realized.

Advantageously, an axial expansion of the at least one undercut relative to the connecting axis can correspond to the corresponding expansion of the clamping area. The expansion of the at least one undercut axial to the connecting axis can advantageously be between 8 mm and approximately 18 mm, preferably approximately 14.2 mm.

In a further advantageous embodiment, at least the insertion section of the at least one bushing receptacle can be at least partially elastic at least in a direction transverse to the connecting axis. In this way, at least a part of the insertion section can elastically yield for insertion and removal of the at least one bushing. In this way, an elastic clamping force, i.e., an elastic mechanical resistance can be realized which must be overcome for removal or insertion of the at least one bushing. By means of the elasticity, in particular mounting-related, component-related and/or operation-related tolerances can be compensated in a simple way. Also, in particular operation-related vibrations can be dampened in this way.

Advantageously, at least one sidewall of the insertion section can be elastic.

In a further advantageous embodiment, at least the bushing receptacle may comprise plastic material or be comprised of plastic material. Advantageously, the plastic material can be elastic. In this way, at least a part of the insertion section can be elastically yielding. Plastic material moreover can be processed easily.

Advantageously, at least the second functional component may comprise plastic material or be comprised of plastic material. In this way, the functional component can be realized in a weight-optimized fashion.

In a further advantageous embodiment, a radial inner circumferential side relative to the connecting axis of the at least one bushing receptacle, in particular of the receiving section, viewed in axial direction toward the connecting element receptacle can widen conically. In this way, mechanical contact between the at least one bushing receptacle and the at least one bushing can be reduced in the widened section. Advantageously, a radial outer circumferential side of the bushing can be spaced apart from the radial inner circumferential side of the bushing receptacle. As a whole, in this way a proportion of the pressing force, which is acting through the at least one connecting element onto the at least one bushing and can be transmitted from the latter onto the at least one bushing receptacle, can be reduced. Moreover, in this way tolerances of various kinds can be compensated better.

An opening angle of the radial inner circumferential side of the at least one bushing receptacle can be advantageously between approximately 0.5 degrees and approximately 5 degrees, in particular 4.5 degrees.

In a further advantageous embodiment, the radial inner circumferential side of the at least one bushing receptacle, in particular the receiving section, can comprise at its end face rim which is facing the connecting element receptacle at least one widened section for receiving at least one projection at the radial outer circumferential side of the at least one bushing. In the at least one widened section the at least one projection of the at least one bushing can be positioned easily. An area of the at least one bushing receptacle which realizes the at least one widened section advantageously can act as a kind of stop for the at least one projection of the at least one bushing. In this way, an insertion depth of the at least one bushing into the at least one bushing receptacle can be limited.

The at least one widened section can be realized by a step in the radial inner circumferential side of the at least one bushing receptacle. The step can be open at one end face of the at least one bushing receptacle. In this way, the at least one bushing can be resting directly on the first functional component, in particular the connecting element receptacle. Accordingly, force transmission between the at least one bushing and the first functional component can be improved.

The at least one widened section can be circumferentially continuous relative to the connecting axis. However, it can also be circumferentially interrupted.

The at least one projection at the radial outer circumferential side of the at least one bushing can be circumferentially continuous or interrupted. Several projections may be provided also.

Moreover, the object is solved according to the invention for the functional component in that the functional component has at least one bushing receptacle in which at least one bushing, which is circumferentially closed relative to the connecting axis and into which the at least one connecting element can be inserted, can be arranged for realizing force transmission between the functional component and the at least one connecting element, wherein the at least one bushing receptacle at a circumferential side relative to the connecting axis comprises an insertion section with an insertion opening for insertion of the at least one bushing into the interior of the at least one bushing receptacle from outside of the circumferential side and/or for removal of the at least one bushing from the at least one bushing receptacle through the circumferential side.

The advantages and features indicated in connection with the connecting device according to the invention and their advantageous embodiments apply likewise to the functional component according to the invention and its advantageous embodiments, and vice versa.

BRIEF DESCRIPTION OF THE DRAWINGS

Further advantages, features, and details of the invention result from the following description in which an embodiment of the invention will be explained in more detail with the aid of the drawing. A person of skill in the art will consider the features disclosed in combination in the drawing, the description, and the claims also expediently individually and combine them to other meaningful combinations.

In the Figures, same components are provided with same reference characters.

DESCRIPTION OF PREFERRED EMBODIMENTS

In FIGS. 1 to 5, a suction pipe 10 of an air intake system of an internal combustion engine of a motor vehicle is illustrated in various views and sections.

Figure 1:
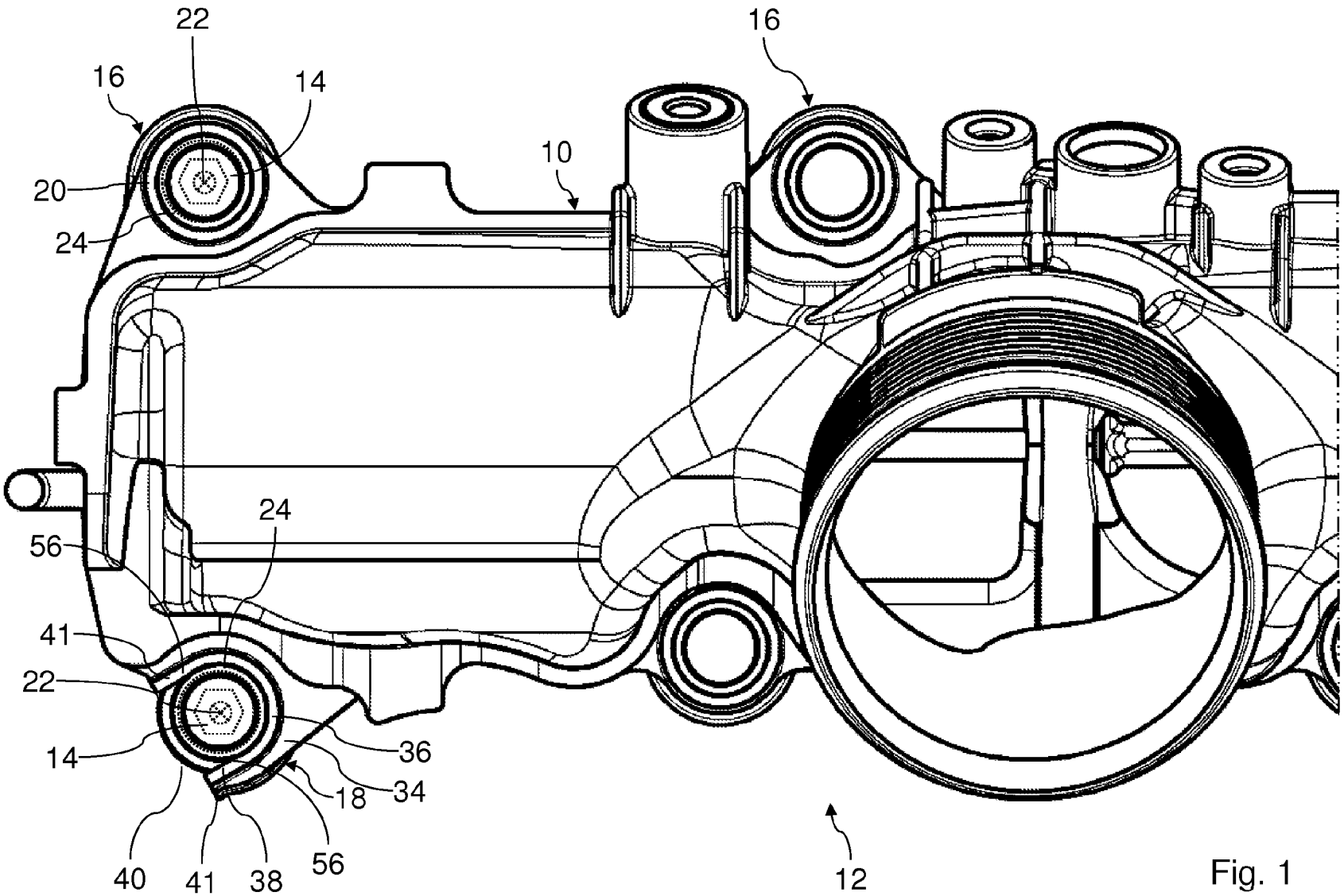
FIG. 1 shows an intake pipe of an internal combustion engine of a motor vehicle with several closed connecting devices and an open connecting device for attachment of the intake pipe on a cylinder head, wherein the open connecting device comprises an open bushing receptacle with a bushing and a screw.
Figure 2:
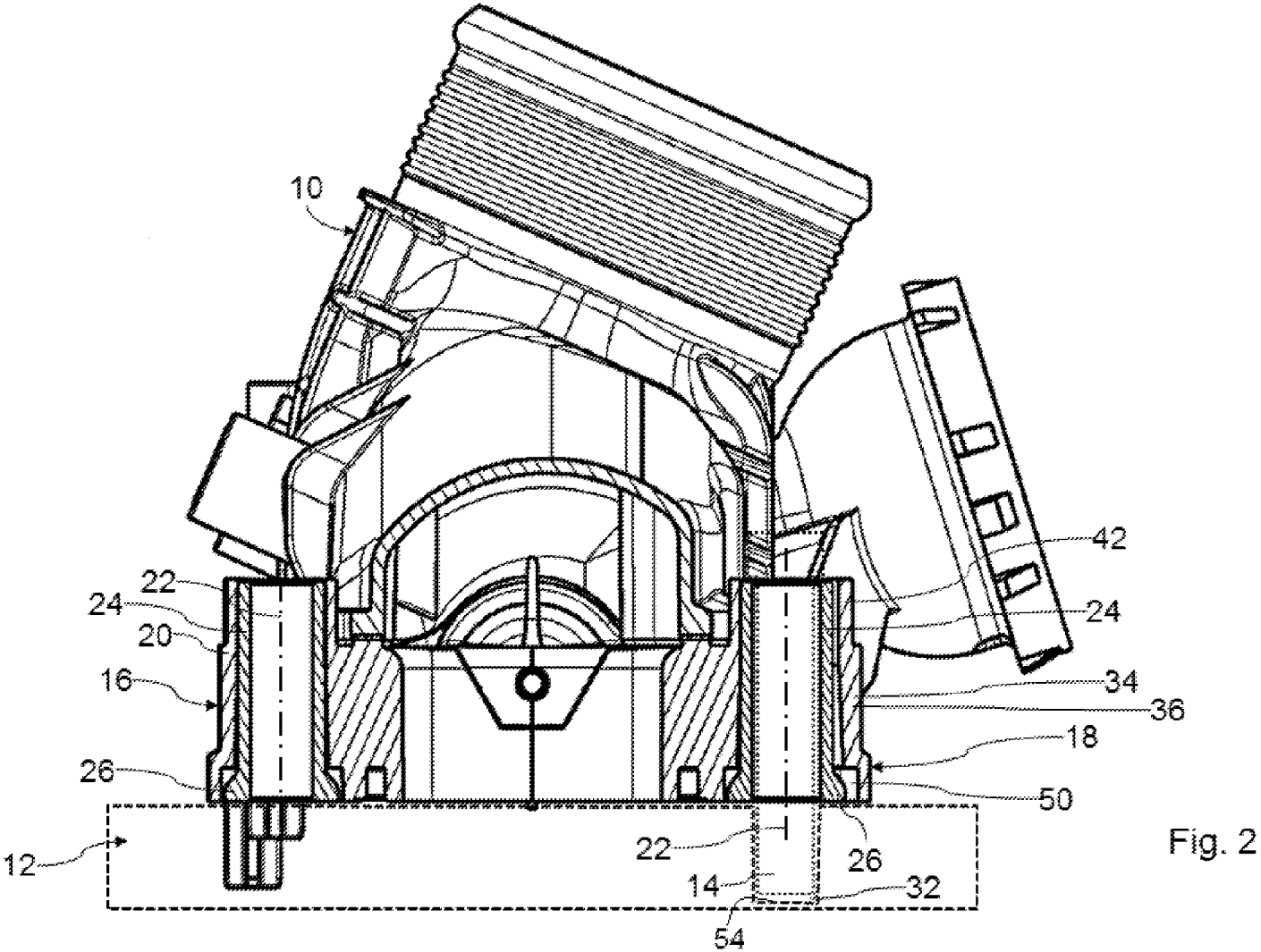
FIG. 2 shows a longitudinal section of the intake pipe of FIG. 1 through the open bushing receptacle with the bushing.
Figure 3:
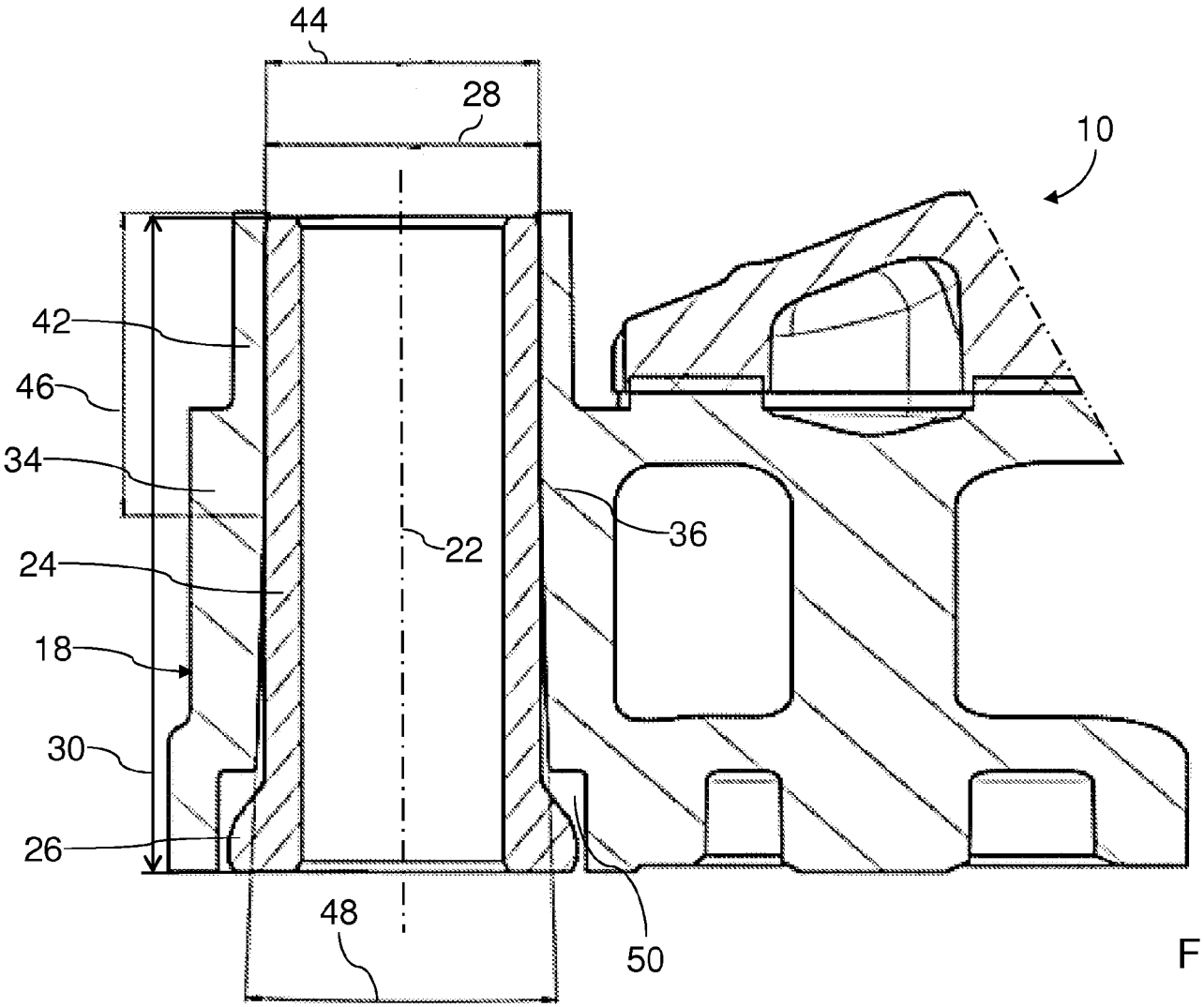
FIG. 3 is a detail view of another longitudinal section of the intake pipe of FIGS. 1 and 2 through the open bushing receptacle with the bushing.

The intake pipe 10 is detachable fastened by several screws 14 on the cylinder head 12 of the internal combustion engine. The cylinder head 12 is indicated in FIGS. 1 and 2. In FIGS. 1 and 2, two, respectively, one of the screws 14 is indicated in an exemplary fashion in dashed lines.

The housing of the suction pipe 10 is made of plastic material. It comprises, distributed on its outer side, a plurality of closed connecting devices 16 and an open connecting device 18 with which the intake pipe 10 is attached on the cylinder head 12. Each of the connecting devices 16 and 18 comprises one of the screws 14.

The closed connecting devices 16 are substantially functionally of a similar design. They each comprise a closed bushing receptacle 20. In each closed bushing receptacle 20, there is a bushing 24 coaxial to a respective imaginary connecting axis 22. A screw 14 is seated in each one of the bushings 24.

The closed bushing receptacles 20 each comprise an approximately circular cylindrical radial inner circumferential side relative to the appropriate connecting axis 22. On the radial inner circumferential sides, the bushing receptacles 20 are stepped, respectively. The bushing receptacles 20 each comprises on their end faces which are facing the cylinder head 12 a cross section-widening receptacle for a projection 26 of the bushing 24 which will be explained infra in more detail.

The bushings 24 each are inserted into the closed bushing receptacles 20 from the side facing the cylinder head 12. The bushings 24 are identical. In an exemplary, fashion, they are commercially available standard bushings. The bushings 24 are comprised of metal. They have substantially the shape of a hollow circular cylinder. The projections 26 already mentioned above are located each on one of the end faces of the bushings 24 at the radial outer circumferential sides. The projections 26 each extend circumferentially continuously in radial outward direction. An outer diameter 28 of the bushings 24 in the area outside of the projections 26 is, for example, 13 mm. The height 30 of the bushing 24 axial to the connecting axis 22 is, for example, 25 mm.

The cylinder head 12 has on the side that is facing the intake pipe 10 several threaded bores 32 for the screws 14. The threaded bores 32 are arranged in accordance with the connecting devices 16 and 18.

The open connecting device 18 comprises an open bushing receptacle 34. The open bushing receptacle 34 is comprised of a receiving section 36 and an insertion section 38 with an insertion opening 40. In the receiving section 36 the appropriate bushing 24 is arranged which corresponds to the bushings 24 of the closed connecting device 16. Through the insertion opening 40, the bushing 24 can be inserted into the open bushing receptacle 34 and/or removed from the open bushing receptacle 34 from the side which is the circumferential side relative to the connecting axis 22.

An inner cross-section of the open bushing receptacle 34, viewed in the direction of the connecting axis 22, is approximately u-shaped. The legs of the "U" are formed by sidewalls 41 of the insertion section 38. The sidewalls 41 delimit the insertion opening 40 relative to the connecting axis 22 at circumferentially opposite sides. The insertion opening 40 extends across the entire axial height of the open bushing receptacle 34 relative to the connecting axis 22.

In the clamping area 42 of the bushing receptacle 34 which is facing away from the cylinder head 12, a radial inner circumferential side of the receiving section 36 has approximately the course of an envelope of an imaginary semi-circular cylinder. An inner diameter 44 of the receiving section 36 in the clamping area 42 is, for example, approximately 12.85 mm. The clamping area 42 extends across an axial height 46 of approximately 14.2 mm.

On the side of the clamping area 42 which is facing the cylinder head 12 the radial inner circumferential side of the receiving section 36 widens conically. An opening angle 48 of the receiving section 36 is, for example, approximately 4.5 degrees.

At its end face which is facing the cylinder head 12, the receiving section 36 has at its radial inner circumferential side a circumferentially extending receptacle 50 for the projection 26 of the bushing 24. The receptacle 50 extends into the two sidewalls 41 of the insertion section 38.

The facing inner sides of the sidewalls 41 extend parallel to each other. The width 52 of the inner sides of the sidewalls 41 transverse to the connecting axis 22 approximately 4 mm is, for example. The spacing of the inner sides of the sidewalls 52 which defines a width 54 of the insertion opening 40, i.e., an inner width of the insertion opening 40, is 12.5 mm, for example. The width 54 of the insertion opening 40 is smaller than the outer diameter 28 of the bushing 24 and smaller than the inner diameter 44 of the receiving section 36 in the clamping area 42.

At the respective transition of the sidewalls 41 of the insertion section 38 into the receiving section 36, there is an undercut 56, respectively. The inner sides of the sidewalls 52 are located within an area which is delimited by two parallel tangential surfaces of the radial inner circumferential side of the receiving sections 38.

For mounting the intake pipe 10 at the cylinder head 12, first the bushing 24 of the open connecting device 18 is fixedly screwed on with the appropriate screw 14 in the appropriate threaded opening 32 of the cylinder head 12. In this context, the end face of the bushing 24 with the projection 26 is arranged on the side which is facing the cylinder head 12.

Figure 4:
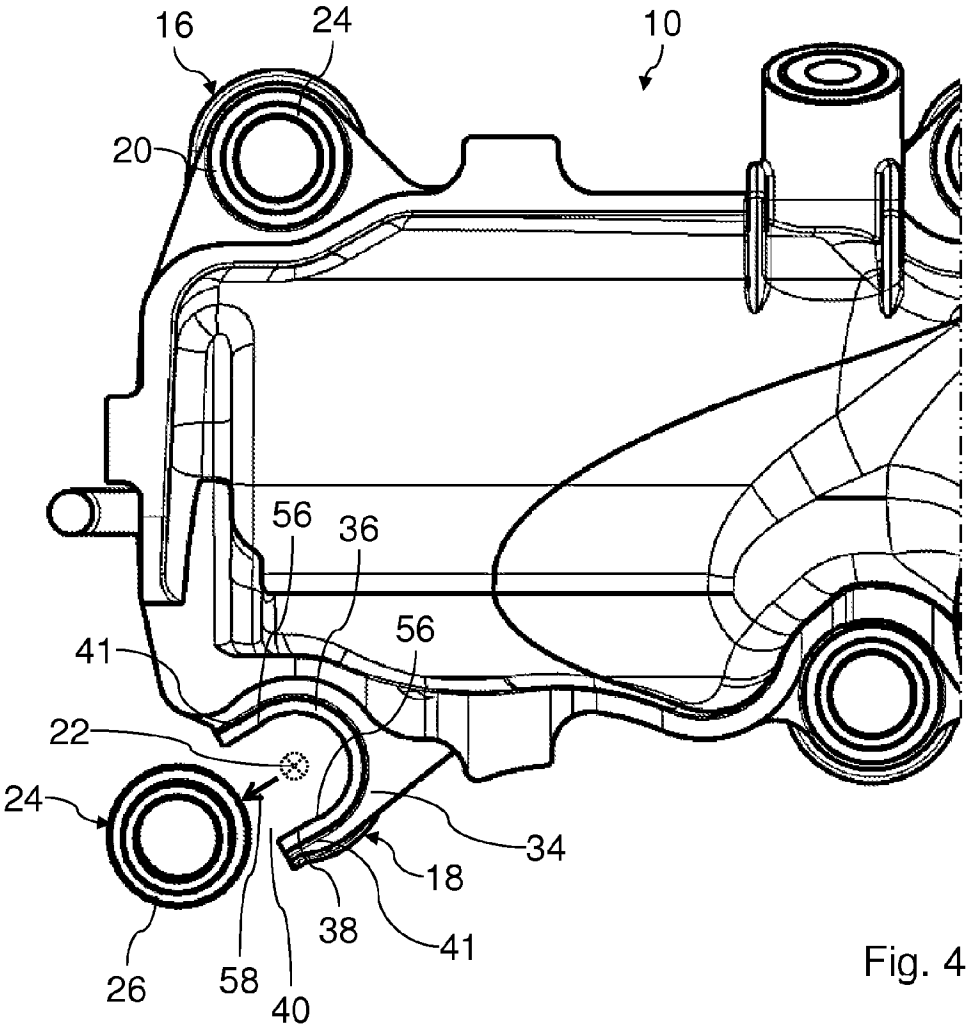
FIG. 4 shows the intake pipe of FIGS. 1 to 3, wherein the bushing is located herein outside of the open bushing receptacle.
Figure 5:
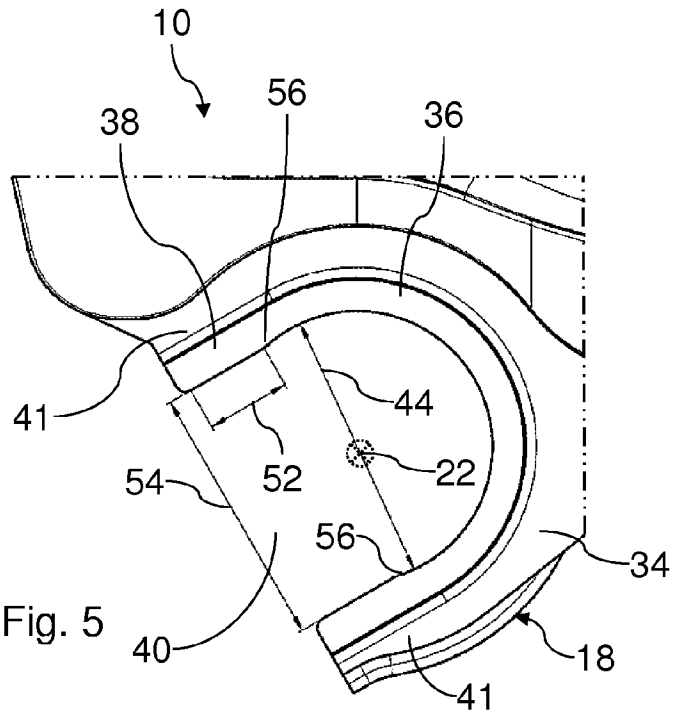
FIG. 5 is a detail view of the open bushing receptacle of the intake pipe of FIGS. 1 through 4, here without bushing.

Subsequently, the intake pipe 10 with the open bushing receptacle 34 is positioned on the fixedly screwed-on bushing 24 such that the radial outer circumferential side of the bushing 24 is resting within the insertion opening 40 on the sidewalls 41 of the insertion section 38 of the open bushing receptacle 34. The cylinder head 12 is pushed with a movement in an insertion direction 58 radially to the connecting axis 22 onto the bushing 24. The insertion direction 58 in FIG. 4 is indicated by an arrow. Upon insertion of the bushing 24 into the insertion opening 44, the sidewalls 41 of the insertion section 38 are elastically pushed away from each other. In this context, an appropriate elastic force must be overcome.

After passing the undercuts 56, the bushing 24 locks in the receiving section 36. The bushing 24 is secured by the elastic clamping connection in the open bushing receptacle 34.

The conical widened section of the receiving section 36 enables positional tolerance. The contact of the radial inner circumferential side of the receiving section 36 with the radial outer circumferential side of the bushing 24 is avoided. In this way, force introduction through the pressing force between the bushing 24 and the open bushing receptacle 34 can be reduced.

Subsequently, the screws 14 of the closed connecting devices 16 are inserted into the appropriate bushings 24 and fixedly screwed into the appropriate threaded bores 32 of the cylinder head 12.

For removal of the intake pipe 10 from the cylinder head 12, first the screws 14 of the closed connecting devices 16 are removed. Subsequently, the clamping connection between the open bushing receptacle 34 and the bushing 24 of the open connecting device 18 is released. For this purpose, the intake pipe 16 is pulled opposite to the insertion direction 52 from the bushing 24 of the open connecting device 18. In this context, the elastic clamping force of the sidewalls 41 must be overcome when passing the insertion section 38.

The screw 14 of the open connecting device 18 must not be released for removal of the intake pipe 10. The appropriate bushing 24 can remain on the cylinder head 12.

Advantageously, the detachable connecting device can be provided for attachment of an intake pipe housing 10 on a cylinder head 12 of an internal combustion engine. The cylinder head 12 can be the first functional component or comprise it. The intake pipe housing 10 can be the second functional component or comprise it. The at least one connecting element receptacle 54 can advantageously be arranged on the cylinder head 12 and may be realized as a threaded bore 32.

While specific embodiments of the invention have been shown and described in detail to illustrate the inventive principles, it will be understood that the invention may be embodied otherwise without departing from such principles.

What is claimed is:

1. A detachable connecting device for connecting a first functional component and a second functional component to each other, the connecting device comprising:

at least one connecting element adapted to be arranged by a rotary and/or plug-in movement relative to an imaginary connecting axis of the connecting device in at least one connecting element receptacle of the first functional component so as to be force-transmitting;

at least one bushing that, relative to the connecting axis, is circumferentially closed and adapted to be arranged on the at least one connecting element;

at least one bushing receptacle provided on the second functional component;

wherein the at least one bushing together with the at least one connecting element is adapted to be arranged in the at least one bushing receptacle for realizing a force transmission between the at least one connecting element and the second functional component;

wherein the at least one bushing receptacle comprises a circumferential side relative to the connecting axis, wherein the circumferential side comprises an insertion section with an insertion opening for insertion of the at least one bushing into the at least one bushing receptacle from outside of the circumferential side into an interior of the at least one bushing receptacle or for removal of the at least one bushing from the interior of the at least one bushing receptacle through the circumferential side;

wherein the at least one bushing receptacle comprises a radial inner circumferential side, relative to the connecting axis, and the radial inner circumferential side widens toward the connecting element receptacle, when viewed in axial direction;

wherein the radial inner circumferential side widens conically.

2. The connecting device according to claim 1, wherein at least the insertion section of the at least one bushing receptacle is at least partially elastic at least in a direction transverse to the connecting axis.

3. The connecting device according to claim 1, wherein at least the at least one bushing receptacle comprises plastic material.

4. The connecting device according to claim 1, wherein the at least one bushing comprises a radial outer circumferential side provided with at least one projection, wherein the radial inner circumferential side comprises an end face rim, facing the at least one connecting element receptacle and provided with at least one widened section for receiving the at least one projection of the radial outer circumferential side of the at least one bushing.

5. A detachable connecting device for connecting a first functional component and a second functional component to each other, the connecting device comprising:

at least one connecting element adapted to be arranged by a rotary and/or plug-in movement relative to an imaginary connecting axis of the connecting device in at least one connecting element receptacle of the first functional component so as to be force-transmitting;

at least one bushing that, relative to the connecting axis, is circumferentially closed and adapted to be arranged on the at least one connecting element;

at least one bushing receptacle provided on the second functional component;

wherein the at least one bushing together with the at least one connecting element is adapted to be arranged in the at least one bushing receptacle for realizing a force transmission between the at least one connecting element and the second functional component;

wherein the at least one bushing receptacle comprises a circumferential side relative to the connecting axis, wherein the circumferential side comprises an insertion section with an insertion opening for insertion of the at least one bushing into the at least one bushing receptacle from outside of the circumferential side into an interior of the at least one bushing receptacle or for removal of the at least one bushing from the interior of the at least one bushing receptacle through the circumferential side;

wherein the at least one bushing receptacle comprises a radial inner circumferential side, relative to the connecting axis, and the radial inner circumferential side widens toward the connecting element receptacle, when viewed in axial direction;

wherein the at least one bushing comprises a radial outer circumferential side provided with at least one projection, wherein the radial inner circumferential side comprises an end face rim, facing the at least one connecting element receptacle and provided with at least one widened section for receiving the at least one projection of the radial outer circumferential side of the at least one bushing.

6. The connecting device according to claim 5, wherein the at least one bushing receptacle comprises an approximately U-shaped inner profile in a radial cross-section relative to the connecting axis.

7. The connecting device according to claim 5, wherein the insertion opening has an inner width at least in a clamping area of the at least one bushing receptacle, viewed in a circumferential direction relative to the connecting axis, wherein the inner width is smaller than an outer diameter of the at least one bushing at least in a section of the at least one bushing that, when the bushing is mounted in the at least one bushing receptacle, is located axially at a level of the clamping area relative to the connecting axis.

8. The connecting device according to claim 5, wherein the at least one bushing receptacle comprises a transition from the insertion section into a receiving section in the interior of the at least one bushing receptacle, wherein the transition comprises an undercut.

9. The connecting device according to claim 8, wherein the receiving section is a clamping area of the bushing receptacle.

10. The connecting device according to claim 5, wherein at least the at least one bushing receptacle is comprised of plastic material.

11. The connecting device according to claim 5, wherein the radial inner circumferential side widens conically.

12. A functional component comprising:

at least one part of a detachable connecting device for connecting said functional component to at least one other functional component, wherein the connecting device comprises at least one connecting element that is adapted to be arranged by a rotary and/or plug-in movement relative to an imaginary connecting axis of the connecting device in at least one connecting element receptacle of the at least one other functional component so as to be force-transmitting;

wherein the at least one part of the detachable connecting device is a bushing receptacle adapted to receive a bushing of the connecting device for realizing a force transmission between the at least one connecting element and said functional component, wherein the bushing is circumferentially closed relative to the connecting axis and adapted to receive the at least one connecting element;

wherein the bushing receptacle comprises a circumferential side relative to the connecting axis and the circumferential side comprises an insertion section with an insertion opening for insertion of the bushing into an interior of the bushing receptacle from outside of the circumferential side or for removal of the bushing from the interior of the bushing receptacle through the circumferential side;

wherein the at least one bushing receptacle comprises a radial inner circumferential side, relative to the connecting axis, and the radial inner circumferential side widens toward the connecting element receptacle, when viewed in axial direction;

wherein the radial inner circumferential side widens conically.

* * * * *